US005211117A

United States Patent [19]

Beamer

[11] Patent Number: 5,211,117

[45] Date of Patent: May 18, 1993

[54] PALLET ASSEMBLY

[75] Inventor: John W. Beamer, Grand Haven, Mich.

[73] Assignee: Lorin Industries, Inc., Muskegon, Mich.

[21] Appl. No.: 757,645

[22] Filed: Sep. 11, 1991

[51] Int. Cl.[5] ..... B65D 19/00

[52] U.S. Cl. ..... 108/51.1; 108/53.1

[58] Field of Search ..... 108/51.1, 56.1, 56.3, 108/53.1, 53.3, 53.5; 248/346; 206/386, 599, 600, 503, 518; 34/237, 238

[56] References Cited

U.S. PATENT DOCUMENTS

| | | | |
|---|---|---|---|
| D. 241,777 | 10/1976 | Allman et al. . | |
| D. 256,007 | 7/1980 | Chillog . | |
| D. 289,939 | 5/1987 | Dash . | |
| D. 291,935 | 9/1987 | Nordstrom . | |
| 1,321,812 | 11/1919 | Drumm . | |
| 1,508,898 | 9/1924 | Smith | 108/51.1 |
| 2,455,197 | 11/1948 | Sullivan | 108/51.1 X |
| 2,463,214 | 3/1949 | Stoner . | |
| 2,568,582 | 9/1951 | Farrar . | |
| 2,602,519 | 7/1952 | Rader | 108/51.1 X |
| 2,615,661 | 10/1952 | Cushman . | |
| 2,668,681 | 2/1954 | Kappen . | |
| 2,692,107 | 10/1954 | DeRidder et al. | 108/51.1 |
| 3,022,028 | 2/1962 | Reinhard et al. . | |
| 3,094,950 | 6/1963 | Brown . | |
| 3,172,374 | 3/1965 | Allen . | |
| 3,393,647 | 7/1968 | Howell . | |
| 3,470,596 | 10/1969 | Belada . | |
| 3,540,385 | 11/1970 | Hobart . | |

(List continued on next page.)

FOREIGN PATENT DOCUMENTS

| | | | |
|---|---|---|---|
| 139272 | 11/1950 | Australia . | |
| 2333811 | 3/1974 | Fed. Rep. of Germany . | |
| 901980 | 7/1962 | United Kingdom . | |
| 9003921 | 4/1990 | World Int. Prop. O. | 108/56.1 |

OTHER PUBLICATIONS

"Skids, Skid Boxes, Pallets", a product brochure published by Fab-Weld Corporation, Philadelphia, Pa., dated Apr. 29, 1948, disclosed on p. 3 a C.B. Section Single Face Pallet and a C.B. Section Double Face Pallet.

Photographs disclose a separator made by Louisville Ladder Company, Louisville, Kentucky about 15 years ago which was utilized as a spacer for boxed meat.

Tog-L-Loc ® Sheet Metal Joining Systems, a product brochure published by BTM Corporation of Marysville, Michigan discloses technical information such as joint strength and typical material thicknesses on p. 3.

*Primary Examiner*—Jose V. Chen

*Attorney, Agent, or Firm*—Price, Heneveld, Cooper, DeWitt & Litton

[57] ABSTRACT

A spacer to facilitate cooling, stacking, and handling of meat includes first and second channels, preferably of identical cross-sectional shape, placed transverse to each other so as to define multiple interconnected passageways for conducting conditioned air therethrough when placed in a stack of alternating layers of boxed meat and spacers The channels include lateral flanges which engage one another at a plurality of intersections where they are joined by pressing a section of material from one lateral flange through the thickness of a section of the other lateral flange followed by clinching the sections together, and further include a web that is spaced from the lateral flanges and positioned to support the edges of boxes of meat thus preventing the boxes from sagging during cooling. The flanges include a hemmed edge and rounded corners that permit safe use by eliminating sharp corners, the hemmed edge also providing a grip to facilitate use of the spacer. The channels are preferably roll-formed from type 3005 aluminum sheet having a thickness of about 0.040 thickness, the aluminum being chosen for its thermal conductivity, strength, workability, low weight, and recycleability. The aluminum also permits cleaning and sanitizing by conventional methods.

22 Claims, 2 Drawing Sheets

U.S. PATENT DOCUMENTS 3,561,374 2/1971 Honderich .
3,581,680 6/1971 Minninger ..... 108/51.1
3,602,157 8/1971 Cohen .
3,616,766 11/1971 Weiss ..... 108/51.1
3,623,631 11/1971 Ford ..... 206/503 X
3,762,344 10/1973 Chez .
3,826,205 7/1974 Weiss .
3,839,970 10/1974 Keeler .
3,924,378 12/1975 Hafner .
3,925,875 12/1975 Doke .
3,927,624 12/1975 Hewson .
3,934,789 1/1976 Allman et al. .
3,976,013 8/1976 Woodford .
4,112,854 9/1978 Pitchford .
4,118,855 10/1978 Lequeux .
4,145,976 3/1979 Svirklys .
4,240,360 12/1980 Sanders et al. .
4,326,467 4/1982 Schleicher et al. .
4,344,368 8/1982 Remington et al. .
4,359,948 11/1982 Judy et al. .
4,375,848 3/1983 Simpson et al. ..... 206/503 X
4,382,414 5/1983 Svirklys .
4,459,735 7/1984 Sawdon .
4,485,744 12/1984 Umemura et al. ..... 108/51.1
4,574,453 3/1986 Sawdon .
4,574,473 3/1986 Sawdon .
4,722,647 2/1988 Sawdon .
4,757,609 7/1988 Sawdon .
4,760,634 8/1988 Rapp .
4,878,284 11/1989 Sawdon .
4,897,912 2/1990 Slasinski .
4,910,853 3/1990 Sawdon .

PALLET ASSEMBLY

BACKGROUND OF THE INVENTION

The present invention relates to a spacer for the food industry useful to facilitate cooling, storage and transportation of packaged meat and the like.

Heretofore, the meat packaging industry has primarily used wood and plastic separators to separate cartons or boxes of processed meats ready to be cooled before shipping or storage. However, the wood and plastic separators are deficient in several ways. Wood and plastic are poor conductors of heat and thus slow the cooling process. Further, the present spacers of wood and plastic do not provide for maximum cross-flow of air. Still further, they are not as durable or repairable as is desired. At the same time, disposal is becoming increasingly expensive due to environmental concerns. For example, wood spacers commonly must be burned as opposed to landfilled. Wood also has the particular problems of splintering and is highly absorbent of liquids such as blood. Further, wood cannot be cleaned and sanitized by conventional methods.

One instance is known where an aluminum separator or spacer was used. The 40 inch by 48 inch spacer consisted of 15 hat-shaped channels, seven of which were oriented transversely to the others and interconnected thereto by rivets, the spacer having a total weight of about 24.5 pounds. However, this spacer presents opportunities for improvement. First, it is desirable that a spacer for use in this application be light in weight so that it is easily handled. Further, there is a risk that rivets will break loose over time and fall into the boxed meat. Hence, it is desirable to use a fastenerless system of attachment which avoids possibilities of contamination. Still further, it is desirable to utilize materials offering improved strength over traditional lower-strength extrudable aluminums so that damage is minimized, weight is minimized, and overall performance is increased. It is also desirable to reduce striations and the like to reduce the tendency to entrap blood, meat particles, and the like on the spacer.

Thus a device is needed which is light in weight, durable, repairable, cleanable, as high strength, and which facilitates cooling of packages of meat and otherwise improves upon the problems noted.

SUMMARY OF THE INVENTION

The present invention is a spacer to facilitate the cooling, stacking, transportation and handling of packaged meat and the like. The spacer includes a plurality of first and second channels interconnected to form multiple passageways so that conditioned air can be freely circulated between and through the channels when the spacers are stacked in a multi-layered arrangement with packages of meat. The channels each include lateral flanges which are positioned to engage at intersections whereby they can be joined by joining means, and further include webs spaced from the flanges having support surfaces for supporting packages of meat thereon to prevent undesired sagging of the packages of meat when stacked.

In one form, the joining means includes a section of material from one of the lateral flanges that is pressed through the thickness of an aligned section of another of said flanges, the sections being clinched together so as to form a secure interconnection of the two lateral flanges In another form, the flanges include an outer edge that is folded back to form a hem to increase safety by reducing the number of exposed sharp edges on the spacer and also to provide a grip for an operator using the spacer.

In another form, the channels have an identical and continuous cross-sectional shape and are made from a sheet of aluminum alloy of about 0.040 inch thickness or less to minimize weight. Preferably, the channels are roll-formed.

As will be understood by persons skilled in the art, numerous advantages over the prior art known spacers are provided by this invention. These include improved air flow and heat transfer, thus reducing cooling time and improving operating efficiency of the meat cooling process. The air flow is improved by providing passageways in two normally oriented directions with open cross-flow therebetween. The construction further assists in heat transfer due to the thermal conductivity of the channels, particularly where aluminum and/or thin gauges of metal are used. Further, the spacers offer improved durability and repairability, and also are cleanable and sanitizable by conventional methods. The spacers of the present invention resist contamination and will not easily stain. Additionally, the aluminum material will not splinter, tear or break, and offers increased load capacity while maintaining the necessary light weight of the spacer. In the preferred embodiment, the construction is fastenerless and thus does not have fasteners that can break loose and contaminate or become lost in the meat. Further, worker safety is increased by radiusing the corners and hemming the edges of the spacer to reduce sharp protrusions. Also, the spacer is constructed of channels with a common roll-formed cross-sectional shape, thus allowing the assembly to be entirely made from long and short lengths of the same sectional shape thereby simplifying the manufacturing process. Roll-forming also allows the channels to be made of materials having significantly greater strength than extruded channels. Further, the spacing between channels can be tailored to the particular need of the intended use, i.e. to adequately support the boxes or packages of meat while minimizing the number of channels used. Also, the spacing between channels allows insertion of forklift forks into the spacer to facilitate material handling.

These and other objects, advantages, purposes, and features of the invention will become more apparent to a person skilled in the art from a study of the following description taken in conjunction with the drawings.

BRIEF DESCRIPTION OF THE PREFERRED EMBODIMENT

Figure 1:
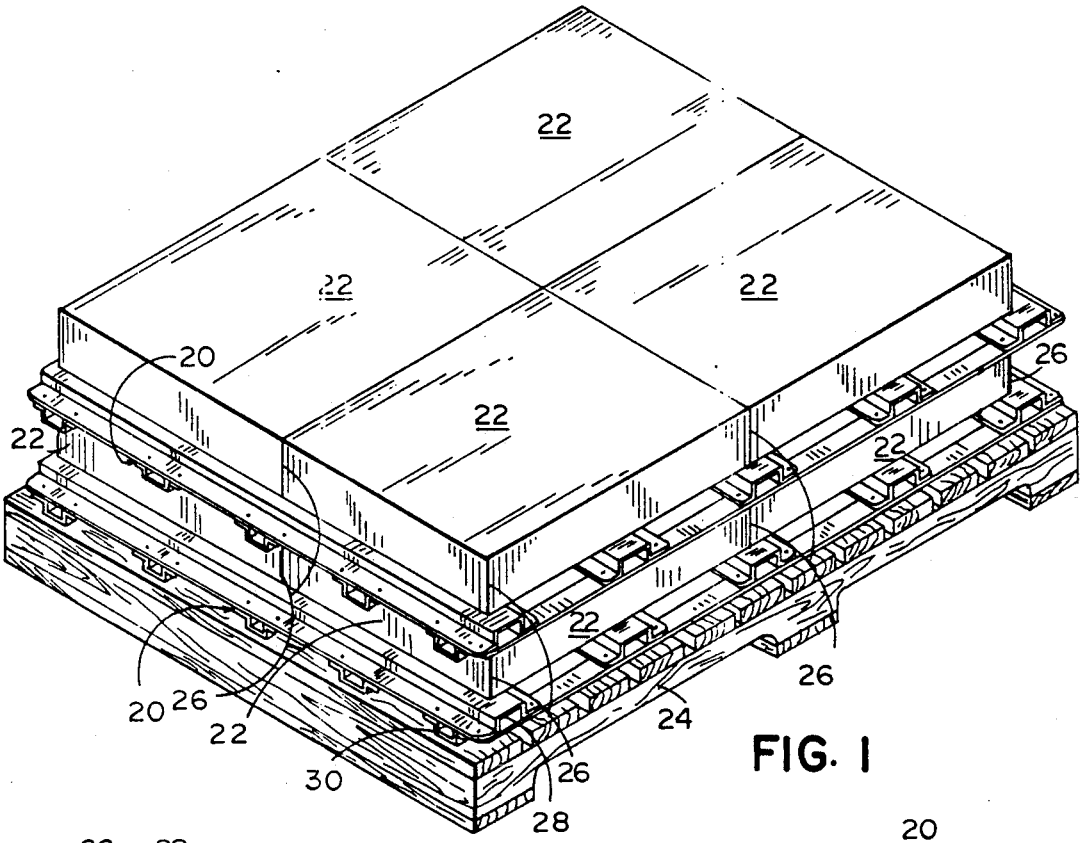
FIG. 1 is a perspective view of spacers embodying the present invention, the spacers being shown as alternatingly placed layers of boxes of meat.
Figure 2:
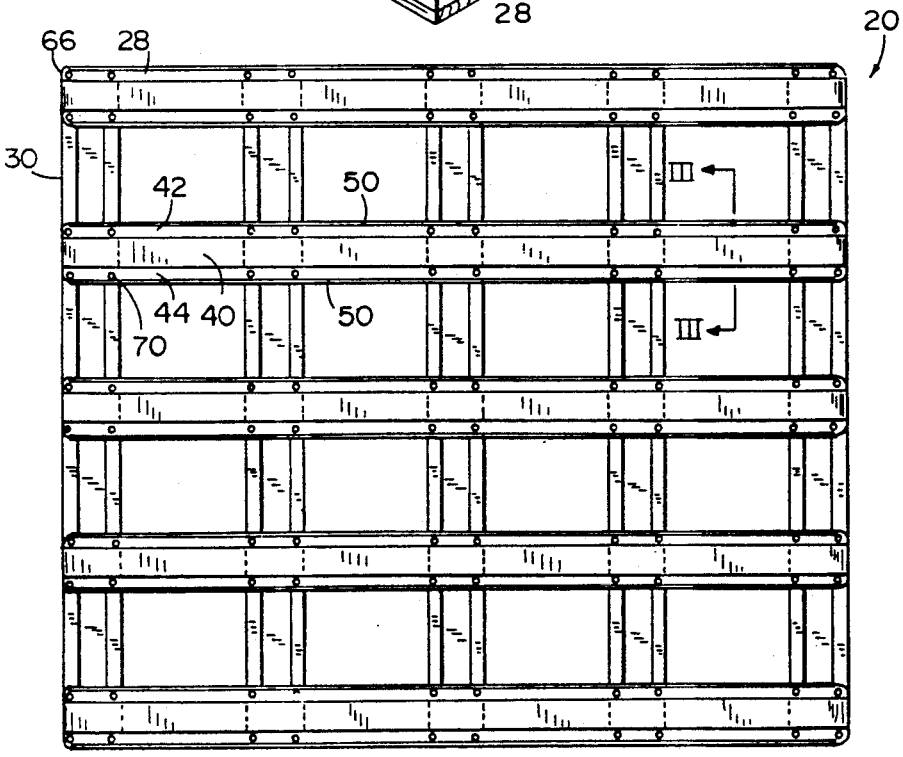
FIG. 2 is a plan view of the spacer.

Referring now to the drawings in greater detail, FIGS. 1 and 2 illustrate a spacer 20 embodying the present invention. Spacer 20 is especially adapted for use in the meat industry to provide a high strength spacer to vertically separate boxes or packages 22 of meat placed in a vertical multi-layered arrangement such as is shown in FIG. 1 on a pallet 24. By spacing the boxes 22 apart, spacers 20 facilitate cross-flow of conditioned air, thus facilitating the cooling of the meat. In the embodiment shown, four boxes 22 are shown on each layer, although more or less boxes can be used. Typically, the arrangement is stacked about 8 layers high.

Figure 3:
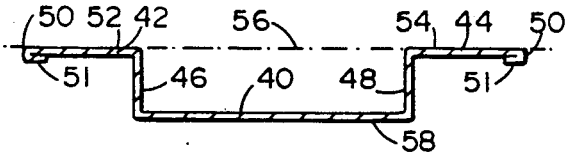
FIG. 3 is a sectional view taken along the plane III—III of FIG. 2.
Figure 4:
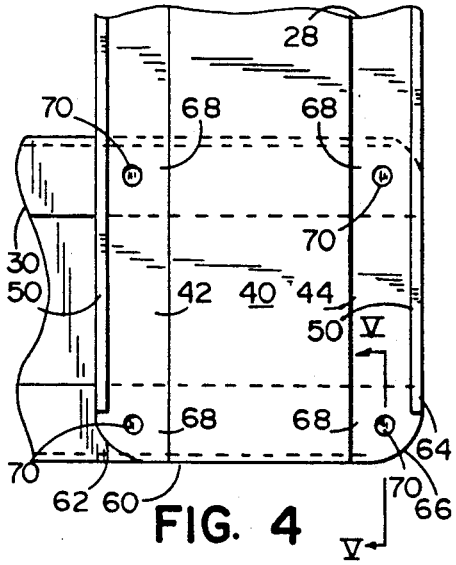
FIG. 4 is an enlarged plan view of a corner of the spacer of FIG. 2.

Spacer 20 (FIGS. 2–4) is constructed of first and second channels 28 and 30 which extend in first and second directions normal to each other to make a spacer 20 of about 40" by 48" by 1" thick. Channels 28 and 30 have identical cross-sectional shapes (FIG. 3), thus permitting them to be made from a common roll-formed or extruded shape to facilitate manufacture. Each channel 28 and 30 has a hat-shaped or "U" shaped section with a web 40 and laterally extending flanges 42 and 44 connected by connecting walls 46 and 48. Flanges 42 and 44 have an outer hemmed edge 50 with a marginal outer edge 51 which is folded back on itself to increase worker safety by reducing worker exposure to sharp edges. Hemmed edge 50 is tightly pressed against the associated flange to minimize entrapment of blood, meat particles, and the like. Hemmed edge 50 also strengthens the edge of flanges 42 and 44, and provides a grip for pulling spacers 20 apart from boxes 22 after freezing. Hemmed edge 50 is folded toward web 40 so that flanges 42 and 44 provide a flat surface 52 and 54 on central plane 56. Web 40 also provides an enlarged flat support surface 58 defining a plane opposite and spaced from central plane 56.

Hemmed edges 50 (FIG. 4) extend substantially the length of channels 28 and 30, but end just short of end 60, forming a corner 62 with end 60. Corner 62 is radiused to eliminate sharp protrusions thereon and reduce curling of the corners. The outermost flanges 42 and 44 on outermost channels 28 and 30 form a perimeter 64 along central plane 56, the corners 62 forming the four corners 66 of the overall spacer perimeter 64.

During manufacture of spacer 20, channels 28 (FIGS. 4–6) are inverted and placed at right angles onto channels 30 to form a matrix of channels. In this position, four planar areas of contact or engagement 68 of flanges 42 and 44 (FIG. 4) are formed at each intersection of channels 28 and 30. Areas 68 are conducively flat for joining channels 28 and 30 so as to form a rigid spacer unit. Additionally, channels 28 and 30 can be spaced as desired and still provide areas 68 for joining. For example, it may be desirable to space channels 28 and 30 more closely so as to support smaller packages of meat. Thus, manufacture of spacers 20 is readily adaptable to varying spacer needs.

Figure 5:
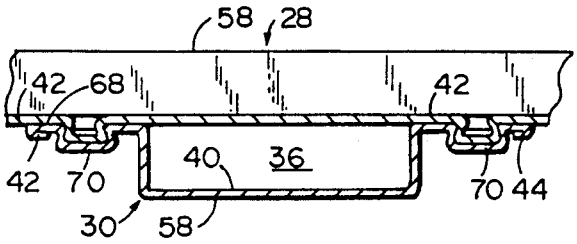
FIG. 5 is a sectional view of the spacer taken along the plane V—V of FIG. 4.
Figure 6:
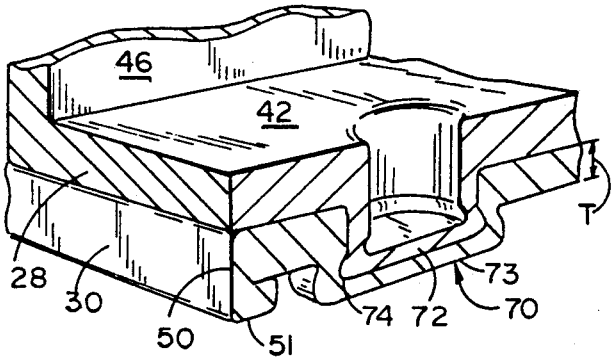
FIG. 6 is an enlarged perspective view of a joint.

In the preferred embodiment, flanges 42 and 44 are joined by a fastenerless system of attachment or joint 70 (FIGS. 5 and 6). This reduces the chance of fasteners or other pieces coming loose over time, and falling into, and contaminating the packages of meat. It is contemplated that welding, riveting, or bent tabs could be used, but in the preferred embodiment a Tog-L-Loc® system of joining is used such as that sold by BTM Corporation of Marysville, Michigan. Such a system of attachment is described in more detail in Sawdon U.S. Pat. No. 4,459,735 entitled Joining Sheet Metal, issued Jul. 17, 1984, the entire contents of which are hereinafter incorporated by reference, and also in subsequently issued patents related thereto. Product literature on Tog-L-Loc® joining systems suggests that it will acceptably work on sheet metal thicknesses of at least 0.060 inches. As best shown in FIG. 6, a slug or section of material 72 from one of channels 28 and 30 is deformably drawn or pressed through the thickness "T" of an aligned section 73 of a flange of the other channel, forming a rivet-like protrusion therein. Sections 72 and 73 are then clinched to form an enlarged head 74 thereon, head 74 being larger than the diameter of the aperture through which it came. Thus a secure attachment is formed tightly holding flanges 42 and 44 together in close proximity so as to prevent liquid or particles from becoming entrapped therein. Presently, it is contemplated that all joints 70 will be made during a single hit or press stroke by suitable forming dies including spaced, multiple punches and anvil pins of the type described in U.S. Pat. No. 4,459,735 mentioned above (not shown). Notably, the dies will be adjustable so that channels 28 and 30 can be spaced as desired.

Figure 7:
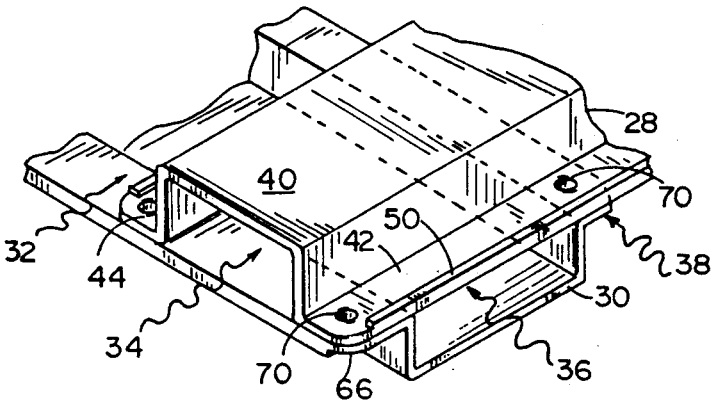
FIG. 7 is a perspective view of FIG. 4 showing air flow.

When fully assembled, spacer 20 provides multiple passageways 32, 34, 36 and 38 (FIG. 7) for conducting conditioned air therethrough. Additionally, air can flow between the passageways, thus enhancing air flow. Also, heat can be conducted through the channel materials thus further promoting efficient cooling. It is contemplated that use of spacers 20 will improve the cooling time for boxed meat by about 12 to 20% over the wood or plastic spacers presently used. Spacers 20 offer about twice the air flow of known wood pallet-like spacers with solid cross-members or plastic "egg-carton" like spacers.

Preferably, channels 28 and 30 are made from a 0.040 inch thick sheet of #3005 aluminum alloy which is hardened to an H34 temper, although alternative materials could be used. It is noted that #3000 aluminum alloys and in particular #3003 aluminum alloy can also be used since these materials have good workability and work acceptably with the Tog-L-Loc® fastening system. Aluminum alloy offers a high strength to weight ratio along with formability, corrosion resistance, cleanability, and recycleability Additionally, aluminum has a good thermal conductivity and also can be readily repaired as needed. Testing has shown that a spacer of the above noted construction made from #3005 alloy can satisfactorily hold up to 12,000 pounds. Notably, most meat processors only require about 1900 pounds of load (i.e. about 240 pounds of boxed meat per layer and stacked 8 layers high). Also, aluminum allows the spacers to be cleaned and sanitized by conventional methods Further, aluminum does not stain.

The beam-like construction of spacer 20 permits the spacing between channels 28 and also between channels 30 to be adjusted so as to optimally place webs 40 for supporting edges 26 of boxes 22. Further, damaged spacers 20 can be repaired by reworking or replacing individual channels. Still further, the spacing between channels permits fork truck forks to be inserted therebetween, facilitating movement of the spacer when needed.

Having described the spacer and various items related thereto, the use and advantages of the present invention will become apparent to one skilled in the art.

It is contemplated that the invention could be used in a variety of ways, though only one way is hereinafter described. Channels 28 and 30 initially are cut from stock to form a blank having a predetermined length and radiused corners. The blank is then roll-formed or extruded into a beam into a U-like sectional shape with hemmed flanges 42 and 44 and web 40 to form channels 28 and 30. Channels 28 are inverted and placed perpendicularly on channels 30 so that flanges 42 and 44 contact along a central plane 56 to form areas of contact 68. Channels 28 and 30 are spaced as desired, and are joined by fastenerless attachments 70 at each area 68 as described in U.S. Pat. No. 4,459,735 mentioned above.

Once assembled, spacer 20 can be placed on a pallet 24 in alternating layers with boxes of meat 22. Various sized boxes 22 can be used, but it is contemplated that the top and bottom of edges 26 of boxes 22 will be positioned on (or under) web 40 as much as possible so that the boxes 22 will be optimally supported in a square and uniform manner. Thus, when alternating layers of boxes 22 and spacers 20 are stacked 8 layers high, the arrangement will remain upright and erect, and not sag unacceptably. This facilitates placement of the stack into a freezer, into refrigerated trucks or trailers for transportation, or the like.

While several forms of the invention have been shown and described, other forms will now be apparent to those skilled in the art. Therefore, it will be understood that the embodiment shown in the drawings and described above are merely for illustrative purposes, and are not intended to limit the scope of the invention which is defined by the claims which follow and as interpreted by the Doctrine of Equivalents.

The embodiments of the invention in which an exclusive property or privilege is claimed are defined as follows.

1. A spacer for supporting packages of meat and the like, comprising:

a plurality of first metal channel members extending in a first direction, each including a pair of first lateral flanges defining a common central plane and further including a first web spaced from said central plane;

a plurality of second metal channel members extending in a direction substantially normal to said first direction, each including a pair of second lateral flanges located on said central plane and further including a second web spaced from said central plane opposite said first webs, said first and second lateral flanges engaging one another at a plurality of intersections on said central plane, said first and second channels forming multiple interconnected passageways for communicating conditioned air therethrough;

said first and second webs including support surfaces defining opposing planes spaced on either side of said central plane for supporting packages of meat and the like placed thereagainst so that said packages and spacer do not undesirably sag as said meat is cooled to a desired temperature, said channels having a structural strength permitting layers of said packages to be alternatingly stacked with said spacers to form a multi-layered arrangement to facilitate cooling, stacking, transportation and handling of said packages of meat; and joining means for interconnecting said first and second lateral flanges at said plurality of intersections so as to form a rigid unit from said first and second channel members, said joining means including a, section of material from one of said lateral flanges which is deformably pressed through said central plane and also through the thickness of an aligned section of the other of said lateral flanges, said sections being clinched together after being pressed therethrough to form a secure interconnection therebetween.

2. The apparatus as set forth in claim 1 wherein said first channels are spaced apart from each other as needed so that said first webs are adapted to match several of the edges of said packages of meat when in said multi-layered arrangement so as to provide support to prevent undesirable sagging of said packages of meat while at the same time minimizing the number of said first channels used, and said second channels are similarly spaced.

3. The apparatus as set forth in claim 2 wherein said first and second channels have an identical hat-like cross-sectional shape, and said spacer being substantially entirely made up of said channels.

4. The apparatus as set forth in claim 3 wherein said spacer is rectangular and defines a perimeter having four corners formed by several of said flanges, said four corners being radiused to increase safety by eliminating sharp corners at said four corners.

5. The apparatus as set forth in claim 4 wherein said first and second lateral flanges each include an outer edge, each of said outer edges being folded back on itself substantially along its entire length to form a hem which eliminates sharp edges therealong, increases the stiffness therealong, and forms a grip that permits an operator to pull one of said spacers apart from said multi-layered arrangement of spacers and packages of meat after cooling.

6. The apparatus as set forth in claim 5 wherein said first and second channels are made of a sheet of metal of less than about 0.060 inch thickness to minimize weight and maximize thermal conductivity.

7. The apparatus as set forth in claim 6 wherein said metal is aluminum chosen for its thermal conductivity, strength, cleanability, sanitizability, and corrosion resistance.

8. The apparatus as set forth in claim 7 wherein said aluminum is a series 3000 aluminum alloy chosen for its strength and workability.

9. The apparatus as set forth in claim 1 wherein said first and second channels have an identical hat-like cross-sectional shape said spacer being entirely made up of said channels.

10. The apparatus as set forth in claim 1 wherein said spacer is rectangular and defines a perimeter having four corners formed by several of said flanges, said four corners being radiused to increase safety by eliminating sharp corners at said four corners.

11. The apparatus as set forth in claim 1 wherein said first and second lateral flanges each include an outer edge, each of said outer edges being folded back on itself substantially along its entire length to form a hem which eliminates sharp edges therealong, increases the stiffness therealong, and forms a grip that permits an operator to pull one of said spacers apart from said multi-layered arrangement of spacers and packages of meat after cooling.

12. The apparatus as set forth in claim 1 wherein said first and second channels are made of a sheet of series 3000 aluminum alloy of less than about 0.040 inch thickness to minimize weight and maximize thermal conductivity.

13. The apparatus as set forth in claim 12 wherein said aluminum is type 3005 aluminum chosen for its strength and workability.

14. A spacer for supporting packages of meat and the like, comprising:

a plurality of first metal channel members extending in a first direction, each including a pair of first lateral flanges defining a common central plane and further including a first web spaced from said central plane;

a plurality of second metal channel members extending in a direction substantially normal to said first direction, each including a pair of second lateral flanges located on said central plane and further including a second web spaced from said central plane opposite said first webs, said first and second lateral flanges engaging one another at a plurality of intersections on said central plane, said first and second channels forming multiple interconnected passageways for communicating conditioned air therethrough;

said first and second webs including support surfaces defining opposing planes spaced on either side of said central plane for supporting packages of meat and the like placed thereagainst so that said packages do not undesirably sag as said meat is cooled to a desired temperature, said channels having a structural strength permitting layers of said packages to be alternatingly stacked with said spacers to form a multi-layered arrangement to facilitate cooling, stacking, transportation and handling of said packages of meat;

said first and second lateral flanges each including an outer edge that is folded back substantially along its entire length to form a hem that eliminates sharp edges therealong, increases the stiffness therealong, and forms a grip that permits an operator to pull one of said spacers apart from said multi-layered arrangement of spacers and packages of meat after cooling; and joining means for interconnecting said first and second later flanges at said plurality of intersections so as to form a rigid unit from said first and second channel members.

15. The apparatus as set forth in claim 14 wherein said outer edge is folded tightly against said lateral flange to minimize areas where meat particles, blood, and related products can be entrapped.

16. The apparatus as set forth in claim 15 wherein said spacer is rectangular and defines a perimeter having four corners formed by several of said flanges, said four corners being radiused to increase safety by eliminating sharp corners at said four corners.

17. The apparatus as set forth in claim 16 wherein said aluminum is a series 3000 aluminum alloy chosen for its strength and workability.

18. The apparatus as set forth in claim 17 wherein said first and second channels have an identical hat-like cross-sectional shape, said spacer being entirely made up of said channels.

19. A spacer for supporting packages of meat and the like, comprising:

a plurality of first metal channel members extending in a first direction, each including a pair of first lateral flanges defining a common central plane and further including a first web spaced from said central plane;

a plurality of second metal channel members extending in a direction substantially normal to said first direction, each including a pair of second lateral flanges located on said central plane and further including a second web spaced from said central plane opposite said first webs, said first and second lateral flanges engaging one another at a plurality of intersections on said central plane, said first and second channels forming multiple interconnected passageways for communicating conditioned air therethrough;

said first and second webs including support surfaces defining opposing planes spaced on either side of said central plane for supporting packages of meat and the like placed thereagainst so that said packages do not undesirably sag as said meat is cooled to a desired temperature, said channels having a structural strength permitting layers of said packages to be alternatingly stacked with said spacers to form a multi-layered arrangement to facilitate cooling, stacking, transportation and handling of said packages of meat;

joining means for interconnecting said first and second lateral flanges at said plurality of intersections so as to form a rigid unit from said first and second channel members; and said first and second channels having an identical and continuous cross-sectional shape and being roll-formed from aluminum alloy sheeting that is about 0.040 inch thick or less.

20. The apparatus as set forth in claim 19 wherein said aluminum is a series 3000 aluminum selected for its strength, low weight, thermal conductivity, and for its ability to be cleaned and sanitized by conventional methods.

21. The apparatus as set forth in claim 20 wherein said aluminum is a 3005 aluminum chosen to optimize the strength of said joining means.

22. A spacer for supporting packages of meat and the like to be cooled, comprising:

a plurality of first metal channel members extending in a first direction, each including a pair of first lateral flanges defining a common central plane and further including a first web spaced from said central plane;

plurality of second metal channel members extending in a direction substantially normal to said first direction, each including a pair of second lateral flanges located on said central plane and further including a second web spaced from said central plane opposite said first webs, said first and second lateral flanges engaging one another at a plurality of intersections on said central plane, said first and second channels forming multiple interconnected passageways for communicating conditioned air therethrough, said first and second channels having an identical and continuous cross-sectional shape and being made from metal sheeting that is about 0.040 inch thick or less, said first and second members forming an open matrix that can be readily cleaned and sanitized by conventional methods;

said first and second webs including support surfaces defining opposing planes spaced on either side of said central plane for supporting packages of meat and the like placed thereagainst so that said packages do not undesirably sag as said meat is cooled to a desired temperature, said channels having a structural strength permitting layers of said packages to be alternatingly stacked with said spacers to form a multi-layered arrangement to facilitate cooling, stacking, and handling of said packages of meat;

said first and second lateral flanges each including an outer edge, each of said outer edges being folded back on itself substantially along its entire length to form a hem that eliminates sharp edges therealong, increases the stiffness therealong, and forms a grip that permits an operator to pull one of said spacers apart from said multi-layered arrangement of spacers and packages of meat after cooling, said lateral flanges further including ends with radiused corners to minimize sharp corners at the ends of said channels; and joining means for interconnecting said first and second lateral flanges at said plurality of intersections so as to form a rigid unit from said first and second channel members, said joining means including a section of material from one of said lateral flanges deformably pressed through said central plane and also through the thickness of an aligned section of the other of said lateral flanges, said sections being clinched together after being pressed therethrough to form a secure interconnection therebetween.

* * * * *